US007155851B2

(12) United States Patent
Ootsuka

(10) Patent No.: US 7,155,851 B2
(45) Date of Patent: Jan. 2, 2007

(54) COLLECTION HOLDER

(75) Inventor: Toshie Ootsuka, Tokyo (JP)

(73) Assignee: Dantsu Tec Inc., Tokyo (JP)

( * ) Notice: Subject to any disclaimer, the term of this patent is extended or adjusted under 35 U.S.C. 154(b) by 37 days.

(21) Appl. No.: 10/343,169

(22) PCT Filed: Jun. 7, 2002

(86) PCT No.: PCT/JP02/05633

§ 371 (c)(1),
(2), (4) Date: Jan. 27, 2003

(87) PCT Pub. No.: WO02/100657

PCT Pub. Date: Dec. 19, 2002

(65) Prior Publication Data

US 2003/0226300 A1 Dec. 11, 2003

(30) Foreign Application Priority Data

Jun. 7, 2001 (JP) ..... 2001-003676

(51) Int. Cl.
*G09F 7/06* (2006.01)
*A63F 9/12* (2006.01)

(52) U.S. Cl. ..... 40/622; 40/600

(58) Field of Classification Search ..... 40/600, 40/621, 622, 711, 720; 434/96, 171, 333, 434/407; 446/118; 206/6.1, 818, 457, 308.1
See application file for complete search history.

(56) References Cited

U.S. PATENT DOCUMENTS

| | | | | |
|---|---|---|---|---|
| 3,345,766 | A | 10/1967 | Timlin | |
| 3,655,194 | A * | 4/1972 | Pierson | 273/258 |
| 3,771,246 | A | 11/1973 | Ebner | |
| 4,050,184 | A | 9/1977 | Chiari | |
| 5,269,083 | A * | 12/1993 | Vampatella et al. | 40/711 |
| 5,444,929 | A * | 8/1995 | Joseloff | 40/759 |
| 5,704,147 | A * | 1/1998 | Rellinger | 40/621 |
| 5,787,622 | A * | 8/1998 | Green et al. | 40/621 |
| 5,816,571 | A * | 10/1998 | Chen | 273/153 S |

FOREIGN PATENT DOCUMENTS

| | | | |
|---|---|---|---|
| DE | 21 59 101 | A | 5/1973 |
| EP | 0 247 750 | A2 | 12/1987 |
| FR | 2548416 | A1 * | 1/1985 |
| JP | 55-40828 | U | 3/1980 |
| JP | 6-46785 | U | 6/1994 |
| JP | 3001079 | U | 6/1994 |
| JP | 08-038681 | A | 2/1996 |

* cited by examiner

*Primary Examiner*—Joanne Silbermann
(74) *Attorney, Agent, or Firm*—Marvin A. Motsenbocker; NDQ&M Watchstone LLP

(57) ABSTRACT

The present invention provides a collection holder which allows a plurality of collection pieces of given shapes to be attached thereto for display. The collection holder is for mounting thereto the collection pieces of given shapes, being formed in a polyhedron with mounting faces for the pieces being connected together in a shell.

11 Claims, 5 Drawing Sheets

COLLECTION HOLDER

TECHNICAL FIELD

The present invention relates to a collection holder for organizing and displaying collection pieces.

BACKGROUND ART

Collectors enjoy collecting collection pieces variously decorated into shapes, patterns and colors and orderly or aesthetically arranging of the collection pieces for display.

For example, flat collection pieces such as cards have been conventionally arranged in frames or put in binders to organize and display them.

Solid collection pieces such as miniature cars have been conventionally put in showcases, for example, to organize and display them.

The present invention has an object of enabling the mounting of a plurality of collection pieces of given shapes for display.

In particular, the present invention has an object of providing a collection holder suitable for organizing and displaying plate-like matters partly having protrusions, such as pin buttons, for the increasing enjoyment of collectors.

DISCLOSURE OF THE INVENTION

A first aspect of the present invention is a collection holder for mounting thereto a plurality of collection pieces of given shapes; the collection holder comprising a plurality of mounting faces for collection pieces; the faces being connected together in a shell, to form a polyhedron.

A second aspect of the invention is that, in the first aspect of the invention, at least a part of the mounting faces and the collection pieces is made of magnetic material.

A third aspect of the invention is that, in the first or second aspect of the invention, the collection holder further comprises bordering protrusions provided at the edges of the mounting faces.

A fourth aspect of the invention is that, in one of the first to third aspects of the invention, the collection pieces are plate-like matters having protrusions provided on surfaces thereof opposite to the mounting faces; and the mounting faces of the polyhedron are provided with openings for inserting the protrusions therethrough.

A fifth aspect of the invention is that, in the fourth aspect of the invention, the plate-like matters are regular hexagons and regular pentagons.

A sixth aspect of the invention is that, in the fifth aspect of the invention, the polyhedron is a 32-panel solid imitating a soccer ball.

A seventh aspect of the invention is that, in one of the fourth to sixth aspects of the invention, the collection pieces are pin buttons.

An eighth aspect of the invention is that, in one of the first to seventh aspects of the invention, the collection holder further comprises recesses formed in part of the mounting faces.

A ninth aspect of the invention is that, in the eighth aspect of the invention, the recesses are circularly formed along the edges of the mounting faces.

A tenth aspect of the invention, in one of the first to ninth aspects of the invention, the collection holder further comprises a mounting base on which the polyhedron is mountable without limitation in orientation.

BEST MODE FOR CARRYING OUT THE INVENTION

A collection holder according to an embodiment of the present invention will be described below with reference to the accompanying drawings.

Figure 1:
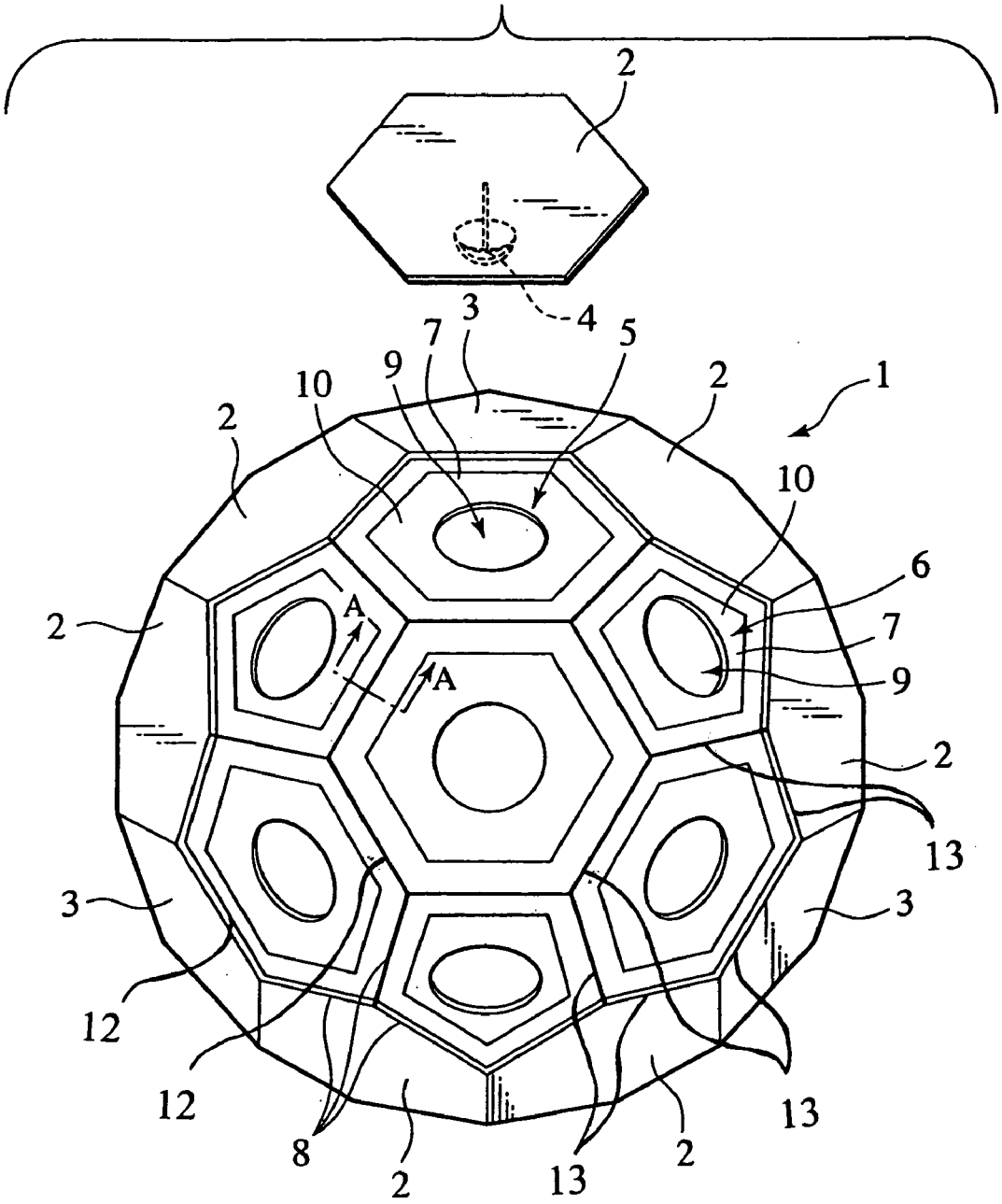
FIG. 1 is a cubic diagram illustrating a collection holder according to an embodiment of the present invention and pin buttons to be secured to the collection holder.

FIG. 1 is a cubic diagram illustrating a collection holder of the embodiment and pin buttons 2 and 3 to be secured to the collection holder 1.

In FIG. 1, one of the pin buttons 2 has not yet been secured to a mounting face 5 of the collection holder 1 and the pin buttons 3 are secured to mounting faces 6 of the collection holder 1.

Figure 2A:
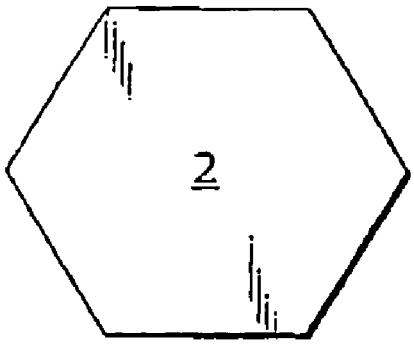
FIG. 2A is a plan view illustrating the shapes of the pin buttons to be secured to the collection holder according to the embodiment of the invention.

Each pin button 2 is, as shown in FIG. 2A, a plate-like member forming a regular hexagon. As shown with a dotted line in FIG. 1, each pin button 2 has a pin 4 for fastening to a garment, fixed to the rear surface thereof.

Figure 2B:
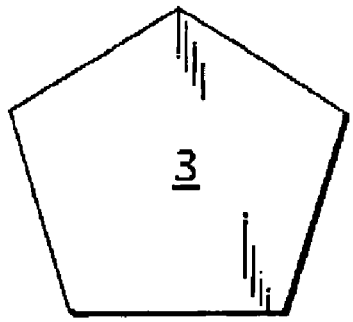
FIG. 2B is a plan view illustrating the shapes of the pin buttons to be secured to the collection holder according to the embodiment of the invention.

Each pin button 3 is, as shown in FIG. 2B, a plate-like member forming a regular pentagon, having a pin (not shown) for fastening to a garment, fixed at the rear surface thereof like the pin button 2.

The pin buttons 2 and 3 are at least partly made of magnetic material such as iron, with front faces variously decorated.

On the other hand, the collection holder 1 is for mounting thereto a plurality of collection pieces of given shapes, the pin buttons 2 and 3 in this embodiment.

More specifically, the collection holder 1 is, as shown in FIG. 1, a polyhedron formed by connecting in a shell the mounting faces 5 of a regular hexagon slightly larger in area than the pin buttons 2 and the mounting faces 6 of a regular pentagon slightly larger in area than the pin buttons 3.

In this embodiment, the collection holder 1 forms an irregular 32-panel solid (hereinafter referred to merely as "32-panel solid"), that is, a 32-panel solid imitating a soccer ball.

Strip-shaped thin magnetic layers 7 are attached at a certain width from the edge regions of the respective mounting faces 5 and 6.

Accordingly the pin buttons 2 and 3 at least partly made of magnetic material can thus be secured to the mounting faces 5 and 6 by magnetic force.

It may also be possible to attach thin magnetic layers to the pin buttons 2 and 3 and to form at least part of the mounting faces 5 and 6 with magnetic material such as iron.

Figure 3:
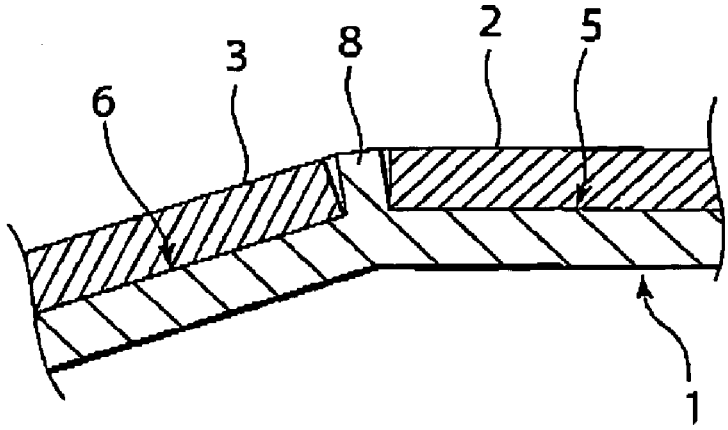
FIG. 3 is a cross-sectional view of the collection holder according to the embodiment of the invention taken along line A—A.

Bordering protrusions 8 are provided at the edges of the mounting faces 5 and 6 as shown in FIG. 3 to facilitate the positioning of the pin buttons 2 and 3 with respect to the mounting faces 5 and 6 and to prevent displacement of the mounted pin buttons 2 and 3.

Openings 9 for insertion of the fastening pins 4 are formed in the mounting faces 5 and 6 in a size which allows the fastening pins 4 to be inserted therethrough with a margin.

Inserting the fastening pins 4 of the pin buttons 2 and 3 through the openings 9 formed in the mounting faces 5 and 6 allows the fastening pins 4 protruding from the rear surfaces of the pin buttons 2 and 3 to be housed inside the shell of the collection holder 1, bringing the pin buttons 2 and 3 into close contact with the mounting faces 5 and 6.

Figure 4:
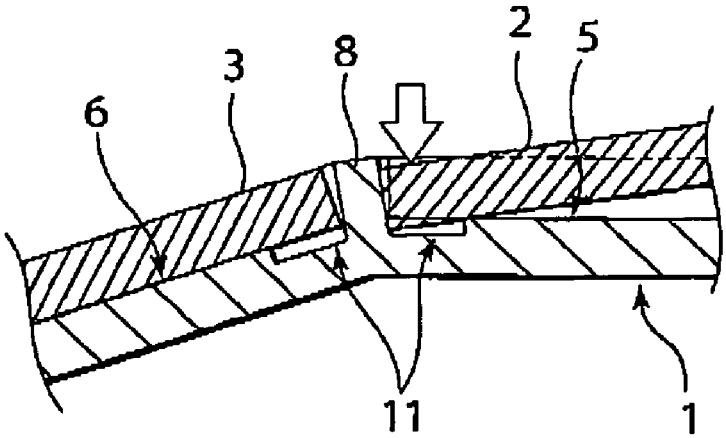
FIG. 4 is a cross-sectional view of the collection holder according to the embodiment of the invention taken along line A—A.

Recesses 11 may be formed in part of the mounting faces 5 and 6. As shown in FIG. 4, for example, the thin magnetic layers attached to the regions indicated by reference numeral 7 may be moved to within regions 10 which are further inside from the regions indicated by 7 and the regions indicated by 7 may be the recesses 11. Black perimeter lines 8 that represent bordering protrusions also indicate locations of adjacent recesses, which may be present on opposite sides as shown by lines 12 in FIG 1, or which may occur at all opposing, parallel sides of each mounting face, with exemplified placements shown by lines 13 for a representative mounting face.

With this arrangement, pushing part of the pin buttons 2 and 3 attached to the mounting faces 5 and 6 into the grooves 11 when removing them from the mounting faces 5 and 6 allows the pin buttons 2 and 3 to be raised up from the mounting faces 5 and 6, facilitating removal of the pin buttons 2 and 3.

When the recesses 11 are circularly formed along the edges of the mounting faces 5 and 6, pushing any portion of the edges of the pin buttons 2 and 3 to be removed allows the pin buttons 2 and 3 to be partly pushed into the grooves 11 and easily raised, increasing the demountability.

Figure 5:
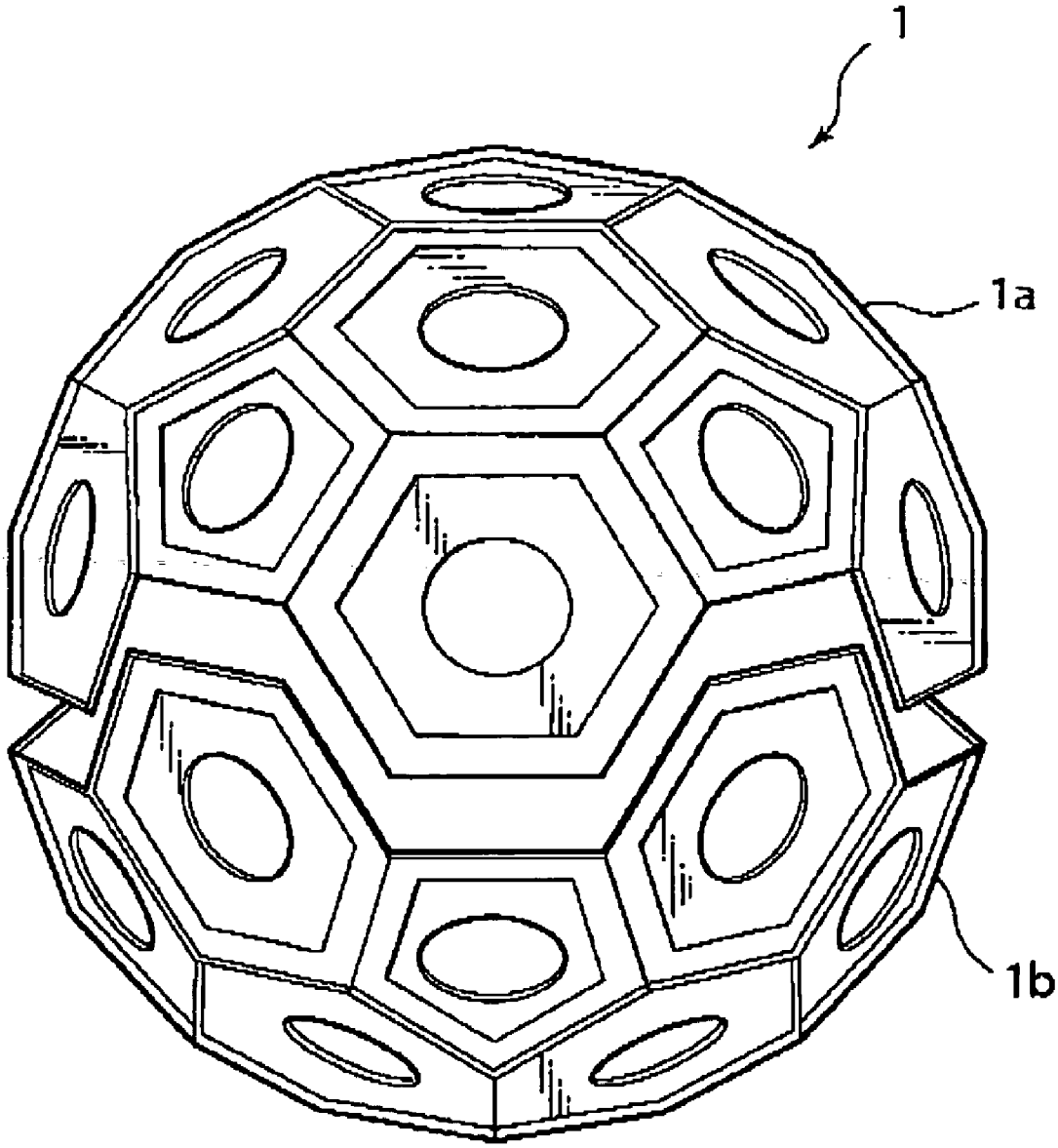
FIG. 5 is an explanatory view of a method for producing the collection holder according to the embodiment of the invention.

In a method of producing the collection holder 1 as shown FIG. 5, the 32-panel collection holder 1 is easily formed by being divided into half shells 1*a* and 1*b* or adequate portions and injection-molding each portion.

Functions and effects obtained from the collection holder 1 according to this embodiment will be summarized below.

The collection holder 1 of this embodiment is formed as a polyhedron with the mounting faces 5 and 6 connected together in a shell, for mounting thereto the plurality of pin buttons 2 and 3 as collection pieces of given shapes.

The collection holder 1 allows the pin buttons 2 and 3 to be attached to the mounting faces 5 and 6 of the collection holder 1 and three-dimensionally and orderly arranged to the shape of the polyhedron.

The collection holder 1 also allows a collector to attach the pin buttons 2 and 3 to the mounting faces 5 and 6 with a sense of doing a puzzle, and to enjoy fitting together the pin buttons 2 and 3 provided with various designs into a solid.

According to the collection holder 1 of this embodiment, at least a part of the mounting faces 5 and 6 and the pin buttons 2 and 3 is made of magnetic material.

The collection holder 1 allows the pin buttons 2 and 3 to be secured to the mounting faces 5 and 6 of the collection holder 1 by magnetic force.

According to the collection holder 1, adequate magnetic force of the magnetic material facilitates detachment of the pin buttons 2 and 3 from the mounting faces 5 and 6.

In the collection holder 1 of this embodiment, the bordering protrusions 8 are provided at the edges of the mounting faces 5 and 6.

The collection holder 1 thus facilitates the positioning of the pin buttons 2 and 3 with respect to the mounting faces 5 and 6 and prevents displacement of the attached pin buttons 2 and 3.

The collection holder 1 provides a decorative effect of bringing the pin buttons 2 and 3 into prominence.

It may also be possible to provide, in place of the bordering protrusions 8, a positioning means such as a kind of key and keyway not shown to the rear surfaces of the pin buttons 2 and 3 and the mounting faces 5 and 6.

In the collection holder 1 of this embodiment, the pin buttons 2 and 3 are plate-like matters having the fastening pins 4 as protrusions on the surfaces (rear surfaces) opposite to the mounting faces 5 and 6 of the collection holder 1, and the openings 9 for inserting therethrough the fastening pins 4 are formed in the mounting faces 5 and 6.

The collection holder 1 allows the pin buttons 2 and 3 to be three-dimensionally and orderly arranged in a shape of the polyhedron.

The collection holder 1 also allows the fastening pins 4 to be inserted through the openings 9 formed in the mounting faces 5 and 6 and housed inside the shell of the collection holder 1, thereby bringing the pin buttons 2 and 3 into close contact with the mounting faces 5 and 6.

In the collection holder 1 of this embodiment, the pin buttons 2 are regular hexagons and the pin buttons 3 are regular pentagons.

The collection holder 1 allows the pin buttons 2 and 3 of regular hexagons and pentagons to be arranged in a three-dimensional and orderly manner to the shape of the polyhedron.

The collection holder 1 of this embodiment is a 32-panel solid consisting of the plurality of regular hexagonal mounting faces 5 and the plurality of regular pentagonal mounting faces 6.

The present inventor noted that a soccer ball is a spherical body of a combination of a plurality of hexagonal and pentagonal elastic panels like the collection holder 1 of this embodiment, and has formed the collection holder 1 as a 32-panel solid imitating a soccer ball.

The collection holder 1 allows the hexagonal and pentagonal pin buttons 2 and 3 to be attached to the mounting faces 5 and 6 of the collection holder 1 and assembled into a solid imitating a soccer ball with designs provided onto the pin buttons 2 and 3 as surface decorations.

Figure 6:
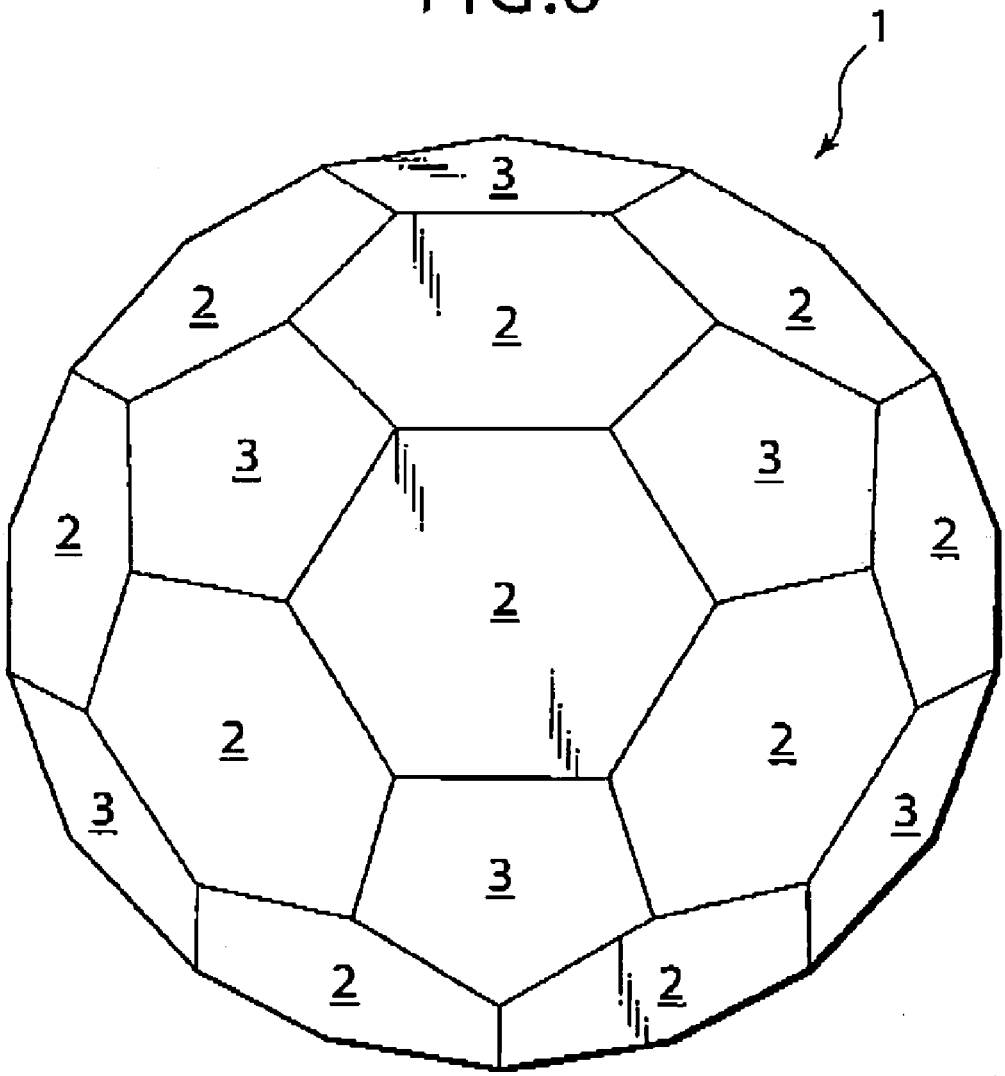
FIG. 6 is a diagram illustrating a state where the pin buttons are secured to all mounting faces of the collection holder according to the embodiment of the invention, forming a solid imitating a soccer ball.

FIG. 6 illustrates a state where the pin buttons 2 and 3 are secured to all of the mounting faces 5 and 6, forming a solid imitating a soccer ball.

In the collection holder 1 of this embodiment, the recesses 11 are formed on a part of the mounting faces 5 and 6.

The collection holder 1 thus allows the pin buttons 2 and 3 attached to the mounting faces 5 and 6 to be partly pushed into the recesses 11 when being removed and easily raised from the mounting faces 5 and 6. This facilitates the removal of the pin buttons 2 and 3.

In the collection holder 1 according to this embodiment, the recesses 11 are circularly formed along the edges of the mounting faces 5 and 6.

The collection holder 1 thus allows the pin buttons 2 and 3 to be partly pushed into the recesses 11 when being removed by pushing any portions of the edges thereof and easily raised from the mounting faces 5 and 6, further increasing the demountability.

Figure 7:
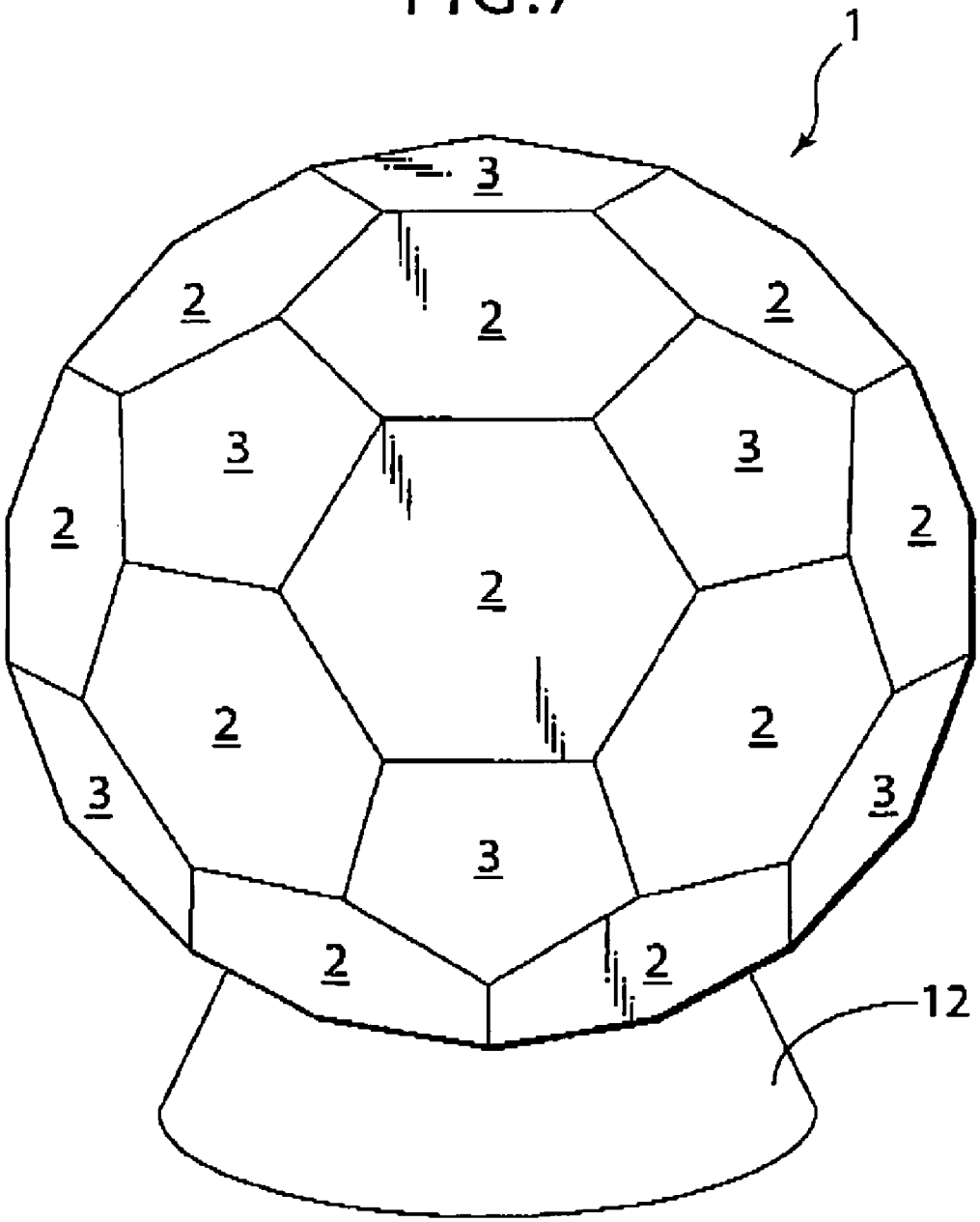
FIG. 7 is a diagram illustrating the collection holder with the pin buttons attached mounted on a mounting base.

The collection holder according to this embodiment may be placed on a mounting base 12 as shown in FIG. 7 without limitation in orientation.

The collection holder 1 can thus be placed in various orientations, providing enjoyment of various combinations of the designs provided onto the pin buttons 2 and 3.

Collection pieces securable to the collection holder 1 are not limited to the pin buttons 2 and 3. Collection pieces of solids of pentagonal pyramids and hexagonal pyramids may be secured to the mounting faces 5 and 6, forming a solid with a plurality of protrusions.

The mounting faces 5 and 6 are not limited to regular hexagons and pentagons. Other shapes may be combined to form another polyhedron.

INDUSTRIAL APPLICABILITY

As described above, the present invention allows a plurality of collection pieces of given shapes to be mounted for display. In particular, the present invention allows the provision of a collection holder suitable for keeping and displaying plate-like matters partly having protrusions, such as pin buttons, increasing the enjoyment of collectors.

The invention claimed is:

1. A three dimensional collection holder having multiple polygonal surfaces, comprising:

a plurality of mounting faces each at a different plane and being connected in a three dimensional shell, thereby forming a polyhedron wherein each mounting face has a plurality of edges; wherein each mounting face has bordering protrusions at the edges thereof that form obtuse angles with respect to the plane of each adjacent mounting face, each mounting face has one or more openings at the center; each mounting face has at least one recess on a bottom edge facing outside, to allow easy removal of magnetic plates that fit into mounting faces of the collection holder; and at least part of each mounting face is made of magnetic material.

2. The three dimensional collection holder described in claim 1, wherein each mounting face has at least two recesses on bottom edges facing outside, of opposing, parallel sides to allow easy removal of magnetic plates that fit into mounting faces of the collection holder.

3. The three dimensional collection holder described in claim 1, wherein all opposing, parallel sides of each mounting face have recesses on their bottom edges facing outside.

4. The three dimensional collection holder described in claim 1, wherein the obtuse angle formed provides a recess opening maximum distance with respect to the perpendicular to the adjacent mounting face at the holder surface that matches the recess opening of the recess on the bottom edge facing outside.

5. A three dimensional polygonal collection holder assembly comprising:

a holder having a plurality of mounting faces each at a different plane and being connected in a three dimensional shell, thereby forming a polyhedron wherein each mounting face has a plurality of edges; wherein each mounting face has bordering protrusions at the edges thereof that forms an obtuse angle with respect to the plane of each adjacent mounting face, each mounting face has one or more openings, each mounting face has at least one recess on a bottom edge facing outside, to allow easy removal of the at least one flat shaped collection plate that fits into mounting faces of the collection holder, and at least part of each mounting face is made of magnetic material; and at least one flat shaped collection plate having a size smaller than the mounting faces and comprising a magnetically responsive material.

6. The three dimensional collection holder assembly described in claim 5, wherein each mounting face has at least two recesses on bottom edges facing outside, of opposing, parallel sides to allow easy removal of the at least one flat shaped collection plate that fits into mounting faces of the collection holder.

7. The three dimensional collection holder assembly described in claim 5, wherein all opposing, parallel sides of each mounting face have recesses on their bottom edges facing outside.

8. The three dimensional collection holder assembly described in claim 5, wherein the obtuse angle formed provides a recess opening maximum distance with respect to the perpendicular to the adjacent mounting face that matches the recess opening of the recess on the bottom edge facing outside.

9. The three dimensional collection holder assembly described in claim 5, wherein each collection plate has a connector located in the middle at a location that corresponds with the location of one or more openings in the mounting faces and wherein the connector is smaller than the one or more openings to allow unobstructed placement of each collection plate within a mounting face.

10. The three dimensional collection holder assembly described in claim 9, wherein the connector is a pin.

11. The three dimensional collection holder assembly described in claim 10, wherein each mounting face has a maximum of one opening.

* * * * *